US011683625B2

(12) United States Patent
Kaiser

(10) Patent No.: US 11,683,625 B2
(45) Date of Patent: Jun. 20, 2023

(54) LIGHT ADAPTOR FOR MICROPHONES

(71) Applicant: Shure Acquisition Holdings, Inc., Niles, IL (US)

(72) Inventor: Jeffrey Kaiser, Roselle, IL (US)

(73) Assignee: Shure Acquisition Holdings, Inc., Niles, IL (US)

( * ) Notice: Subject to any disclaimer, the term of this patent is extended or adjusted under 35 U.S.C. 154(b) by 99 days.

(21) Appl. No.: 17/082,622

(22) Filed: Oct. 28, 2020

(65) Prior Publication Data

US 2021/0144459 A1 May 13, 2021

Related U.S. Application Data

(60) Provisional application No. 62/931,963, filed on Nov. 7, 2019.

(51) Int. Cl.

| | |
|---|---|
| ***H04R 1/08*** | (2006.01) |
| ***F21V 33/00*** | (2006.01) |
| ***H05B 45/20*** | (2020.01) |
| ***G08B 5/36*** | (2006.01) |
| ***H05B 47/12*** | (2020.01) |
| ***H05B 45/10*** | (2020.01) |
| ***F21Y 115/10*** | (2016.01) |

(52) U.S. Cl.

CPC ..... *H04R 1/083* (2013.01); *F21V 33/0056* (2013.01); *G08B 5/36* (2013.01); *H05B 45/10* (2020.01); *H05B 45/20* (2020.01); *H05B 47/12* (2020.01); *F21Y 2115/10* (2016.08)

(58) Field of Classification Search

CPC ..... H05B 47/12; H05B 45/20; H05B 45/10; H04R 1/083; H04R 1/00; H04R 1/04; H04R 1/02; H04R 1/08; G08B 5/36; F21V 33/0056

See application file for complete search history.

(56) References Cited

U.S. PATENT DOCUMENTS

| | | | | |
|---|---|---|---|---|
| 39,570 A * | 8/1863 | Harmon | A41B 11/02 2/241 |
| 4,396,800 A * | 8/1983 | McDonnell | H04R 3/005 379/167.01 |
| 5,244,409 A * | 9/1993 | Guss, III | H01R 13/6691 439/736 |
| 5,988,585 A | 11/1999 | Eaton | |

(Continued)

FOREIGN PATENT DOCUMENTS

| | | |
|---|---|---|
| CN | 201718017 | 1/2011 |
| CN | 102368816 | 3/2012 |

(Continued)

OTHER PUBLICATIONS

BONAOK Wireless Bluetooth Karaoke Microphone with Controllable LED Lights—Amazon (Year: 2018).*

(Continued)

*Primary Examiner* — Arman B Fallahkhair

(74) *Attorney, Agent, or Firm* — Neal, Gerber & Eisenberg LLP

(57) ABSTRACT

A light adaptor is provided that can be installed between the base and the head of a microphone and is controllable by communications between the base and the adaptor. The light adaptor may assist in the control of speaker queuing and other functions.

17 Claims, 6 Drawing Sheets

(56) References Cited

U.S. PATENT DOCUMENTS

| | | | | |
|---|---|---|---|---|
| 6,000,948 | A * | 12/1999 | Peterson | H04R 1/08 439/22 |
| 6,317,503 | B1 * | 11/2001 | Mercs | H04S 1/00 84/625 |
| 6,532,218 | B1 | 3/2003 | Shaffer | |
| 6,690,804 | B2 * | 2/2004 | Everett | F21V 33/0056 362/86 |
| 6,882,971 | B2 | 4/2005 | Craner | |
| 7,006,614 | B2 | 2/2006 | Feinberg | |
| 7,306,347 | B2 * | 12/2007 | Selover | H04R 1/08 362/86 |
| 7,317,808 | B2 * | 1/2008 | Niehoff | H04R 1/04 381/361 |
| 7,440,556 | B2 | 10/2008 | Bear | |
| 8,170,260 | B2 | 5/2012 | Reining | |
| 9,210,524 | B2 | 12/2015 | Sherwood | |
| 9,712,246 | B2 | 7/2017 | Cook | |
| 9,900,729 | B2 | 2/2018 | Grohman | |
| 10,893,366 | B1 * | 1/2021 | Yang | H04R 1/025 |
| 10,911,082 | B2 * | 2/2021 | You | H04B 1/20 |
| 11,265,636 | B1 * | 3/2022 | Kim | F21V 23/003 |
| 11,415,312 | B2 * | 8/2022 | Xia | H04R 1/08 |
| 2007/0030984 | A1 | 2/2007 | Gotfried | |
| 2021/0219039 | A1 * | 7/2021 | Robateau | G10H 1/365 |
| 2022/0051676 | A1 * | 2/2022 | Li | G10L 15/25 |
| 2023/0039570 | A1 * | 2/2023 | Yang | F21V 23/003 |

FOREIGN PATENT DOCUMENTS

| | | | |
|---|---|---|---|
| CN | 202856809 | 4/2013 | |
| CN | 206181300 | 5/2017 | |
| CN | 206237564 | 6/2017 | |
| CN | 206517557 | 9/2017 | |
| EP | 1686835 | 8/2006 | |
| EP | 2394441 | 12/2011 | |
| WO | 2010091349 | 8/2010 | |
| WO | WO-2017145434 A1 * | 8/2017 | H04M 3/56 |

OTHER PUBLICATIONS

AT8656/LED, Information Sheet, audio-technica, Obtained from web page <https://eu.audio-technica.com/AT8656LED> on Jul. 31, 2019.

AT8657/LED, Information Sheet, audio-technica, Obtained from web page <https://eu.audio-technica.com/AT8657LED> on Jun. 8, 2019.

Barinas, Information Sheet, DM 6010 Digital Conferencing/Simultaneous Interpretation System, Retrieved from web page <https://www.barinas.com/DM%206010.htm> on Jul. 31, 2019, 1 p.

BONAOK Wireless Bluetooth Karoake Singing Microphone with Flashing Lights, Amazon sale page, obtained from website <https://www.amazon.com/BONAOK-Wireless-Bluetooth-Microphone-Flashing/dp/B07MCT2JK2/ref=pd_lpo_sbs_267_img_0?_encoding=UTF8&refRID=1NA9CZXHWP8H66CTKCT5&th=1>, date unknown but believed to be at least as early as Jul. 31, 2019, 10 pp.

Kids Microphone, Wireless Portable Karaoke Microphone for Kids, Amazon sale page, obtained from website <https://www.amazon.com/Microphone-Wireless-Bluetooth-Compatible-Smartphone/dp/B07F8FYFT7/>, date unknown but believed to be at least as early as Jul. 31, 2019, 8 pp.

Liles, "Technology Showcase: Audioconferencing Systems," Beale Street Audio, Inc., Apr. 1, 2007, 12 pp.

* cited by examiner

LIGHT ADAPTOR FOR MICROPHONES

CROSS-REFERENCE TO RELATED APPLICATIONS

This application claims priority from U.S. Provisional Application Ser. No. 62/931,963, filed on Nov. 7, 2019, the content of which is incorporated herein by reference in its entirety.

TECHNICAL FIELD

This application generally relates to a light adaptor for microphones. In particular, this application relates to a light adaptor than can be installed between the base and the head of a microphone and that is controllable by communications between the base and the adaptor.

BACKGROUND

Environments such as conference rooms, boardrooms, video conferencing applications, and the like, can involve the use of microphones for capturing sound from various audio sources active in such environments. Such audio sources may include humans speaking, for example. The captured sound may be disseminated to a local audience in the environment through amplified speakers (for sound reinforcement), or to others remote from the environment (such as via a telecast and/or a webcast). A typical microphone may include a microphone head (having a microphone cartridge to sense and capture sound) that can be attached to a handheld microphone base (with components to wired or wirelessly transmit an audio signal containing the captured sound).

Such environments may host meetings where multiple people may desire to speak, for example. In situations where there is a single microphone, people who are potential speakers can request use of the microphone to speak, e.g., by raising their hand, but this scheme can be slow and awkward as the microphone is physically moved from person to person. In other situations where there are multiple microphones for use by potential speakers, it may be difficult for meeting moderators and technicians to keep track of the order of speaking requests and/or ensure the correct microphone is activated for the particular person whose turn it is to speak, which can result in frustration and inefficiency in running the meeting.

Existing microphones may include lights to indicate whether a microphone is on, off, or muted, and such lights may only be a single point source. Other existing microphones may include buttons and switches to control the power or other settings and parameters of the microphone. Existing systems may include separate components that a moderator or technician can control to activate a particular microphone. However, these features of existing microphones and systems may not help in the multiple microphone situations described above where there are potentially many speakers who desire to speak. Moreover, it may not be desired to purchase new and/or proprietary microphone and systems for this purpose when there are existing microphones that are still functional.

Accordingly, there is an opportunity for adaptors and microphone systems that address these concerns. More particularly, there is an opportunity for a light adaptor than can be installed between the base and the head of a microphone and that is controllable by communications between the base and the adaptor to assist in the control of speaker queuing and other functions.

SUMMARY

The invention is intended to solve the above-noted problems by providing an adaptor for microphones that is designed to, among other things: (1) be retrofittable and easily installed between a microphone head and a microphone base of existing microphones; (2) enable a light source of the adaptor to be controlled based on communications between the adaptor and the microphone base; and (3) maintain connectivity of audio and power signals between the microphone base and a microphone head.

In an embodiment, an adaptor for installation between a microphone base and a microphone head may include a first fastening element adapted to secure the adaptor and the microphone base together; a second fastening element adapted to secure the adaptor and the microphone head together; a processor; a communications interface in communication with the processor, and configured to communicate with the microphone base; and a light source in communication with the processor. The light source may be controllable by the processor based on data received from the microphone base through the communications interface.

In another embodiment, a microphone system may include a microphone base; a microphone head configured to sense sound waves and generate an audio signal based on the sensed sound waves; and a light adaptor detachably connected between the microphone base and the microphone head. The light adaptor may include a communications interface configured to communicate with the microphone base; a light source configured to be controlled based on data received through the communications interface; and one or more electrical connections configured to convey signals between the microphone base and the microphone head.

In a further embodiment, a method for controlling a light source of a light adaptor configured for installation between a microphone base and a microphone head may include receiving a first signal at a base processor of the microphone base; and in response to receiving the first signal, transmitting a first command from the base processor to a communications transmitter of the microphone base, where the first command is for controlling a light source of the light adaptor to be a first color. The method may also include receiving the first command at a communications receiver of the light adaptor; and in response to receiving the first command, controlling the light source of the light adaptor to be the first color, using an adaptor processor. The method may further include receiving a second signal at the base processor of the microphone base; and in response to receiving the second signal, transmitting a second command from the base processor to the communications transmitter of the microphone base, where the second command is for controlling the light source of the light adaptor to be a second color. The method may also include receiving the second command at the communications receiver of the light adaptor; and in response to receiving the second command, controlling the light source of the light adaptor to be the second color, using the adaptor processor.

These and other embodiments, and various permutations and aspects, will become apparent and be more fully understood from the following detailed description and accompanying drawings, which set forth illustrative embodiments that are indicative of the various ways in which the principles of the invention may be employed.

DETAILED DESCRIPTION

Figure 1A:
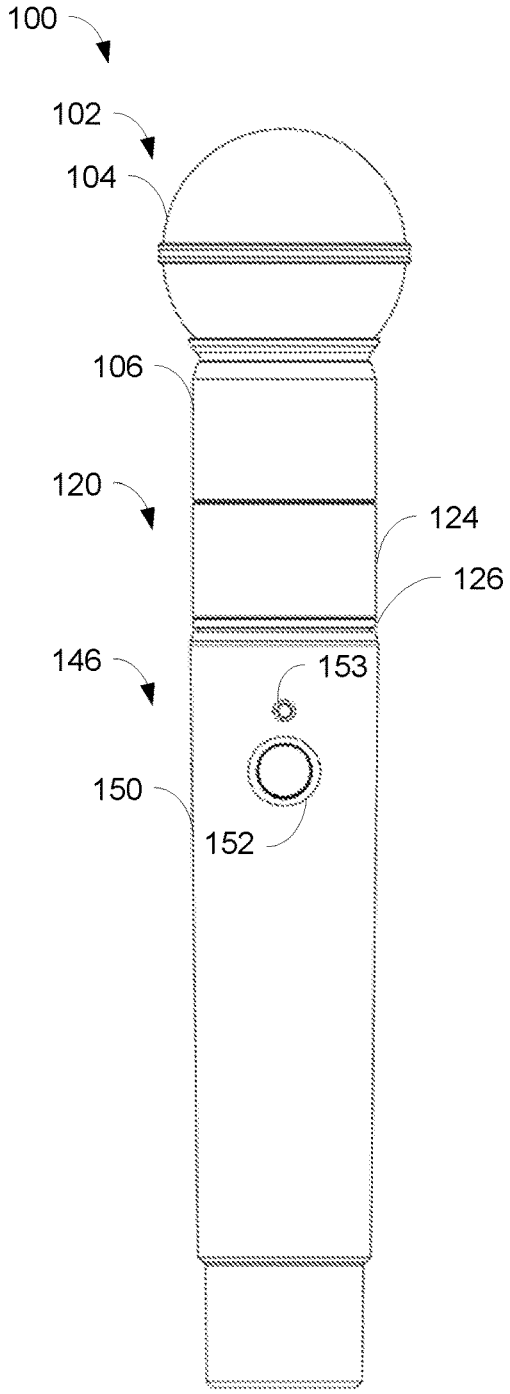
FIG. 1A is a view of an embodiment of a microphone system including a microphone head, a light adaptor, and a microphone base.

The description that follows describes, illustrates and exemplifies one or more particular embodiments of the invention in accordance with its principles. This description is not provided to limit the invention to the embodiments described herein, but rather to explain and teach the principles of the invention in such a way to enable one of ordinary skill in the art to understand these principles and, with that understanding, be able to apply them to practice not only the embodiments described herein, but also other embodiments that may come to mind in accordance with these principles. The scope of the invention is intended to cover all such embodiments that may fall within the scope of the appended claims, either literally or under the doctrine of equivalents.

It should be noted that in the description and drawings, like or substantially similar elements may be labeled with the same reference numerals. However, sometimes these elements may be labeled with differing numbers, such as, for example, in cases where such labeling facilitates a more clear description. Additionally, the drawings set forth herein are not necessarily drawn to scale, and in some instances proportions may have been exaggerated to more clearly depict certain features. Such labeling and drawing practices do not necessarily implicate an underlying substantive purpose. As stated above, the specification is intended to be taken as a whole and interpreted in accordance with the principles of the invention as taught herein and understood to one of ordinary skill in the art.

The light adaptor as described herein can add a controllable light source to a microphone while maintaining connectivity of audio and power signals between a microphone base and a microphone head. Microphones with the light adaptor installed can be utilized to assist in speaker queuing functions, such as by allowing a meeting moderator to control the light source to indicate a speaker's place in a queue and/or the activation status of the microphone. The light adaptor may be user installable because it is able to be connected between the microphone base and the microphone head. Audio and power signals may continue to be communicated between the microphone base and the microphone head through the light adaptor.

The light source may be controlled via communication between the light adaptor and the microphone base. In particular, the microphone base may wired or wirelessly communicate with a controlling component, such as a moderator unit in a meeting environment. The controlling component can transmit a command to the microphone base to control the light source. The command may include turning the light source on or off, turning the light source a particular color, causing the light source to be a different intensity, and/or causing the light source to flash or be solid. The microphone base can communicate with the light adaptor, such as through infrared communication. The light adaptor can control the light source based on the received command.

Use of the light adaptor with a microphone may provide advantages to speakers, moderators, technicians, etc. For example, speakers may benefit by being able to easily see whether the microphone they are using is activated and/or seeing their place in a speaking queue. There may also be less confusion for moderators and technicians because the light adaptor can assist them in keeping track of the speaking queue and in ensuring that the correct microphone is activated for a particular speaker. Furthermore, existing microphones having a microphone head and a microphone body can still be utilized by retrofitting them with the light adaptor, in lieu of purchasing new and/or proprietary equipment. Moreover, microphones can be purchased without the light adaptor and light adaptors can be later added if its functionality is desired.

Figure 1B:
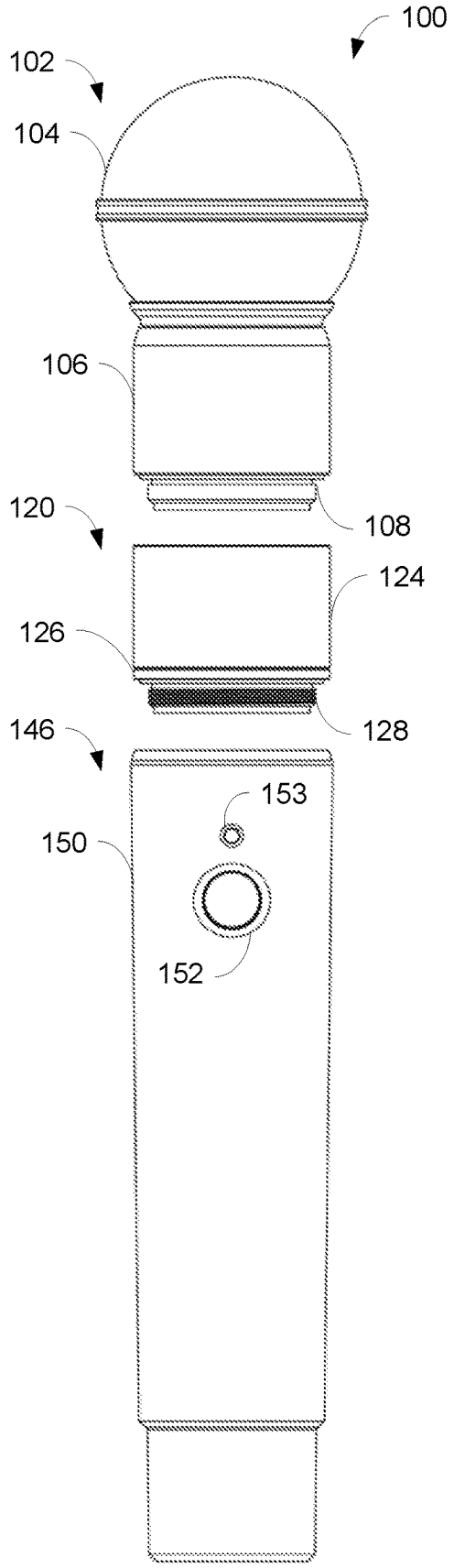
FIG. 1B is an exploded view of the embodiment shown in FIG. 1A of a microphone system including a microphone head, a light adaptor, and a microphone base.
Figure 1C:
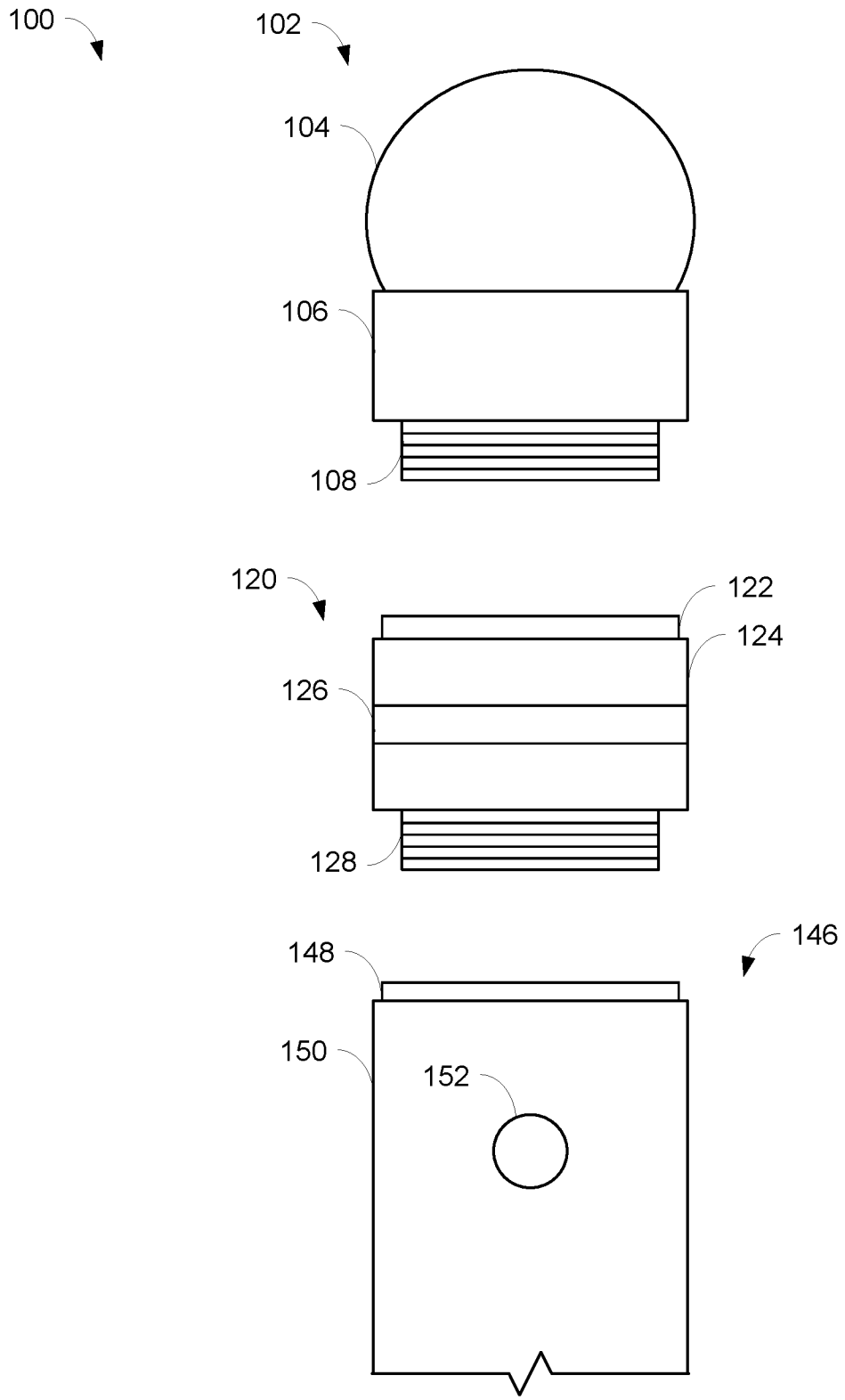
FIG. 1C is an exploded depiction of an alternative embodiment of a microphone system including a microphone head, a light adaptor, and a microphone base.
Figure 2:
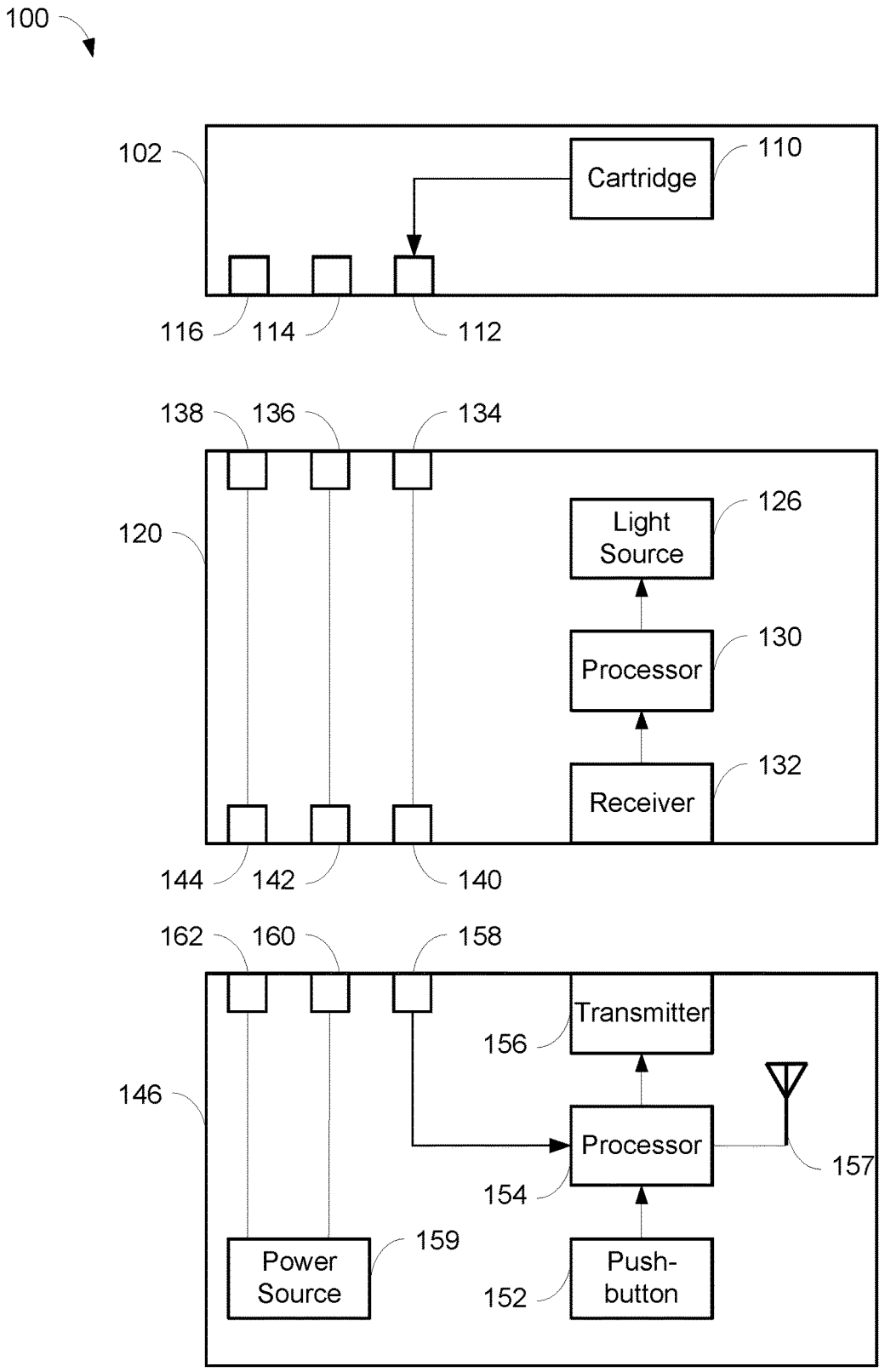
FIG. 2 is a schematic diagram of certain components of the microphone systems of FIGS. 1A, 1B, and 1C, in accordance with some embodiments.

FIG. 1A is a view of an embodiment of a microphone system 100 that includes a microphone head 102, a light adaptor 120, and a microphone base 146. FIG. 1B is an exploded view of the embodiment shown in FIG. 1A of the microphone system 100 that includes the microphone head 102, the light adaptor 120, and the microphone base 146. FIG. 1C is an exploded depiction of an alternative embodiment of a microphone system 100 that includes a microphone head 102, a light adaptor 120, and a microphone base 146. FIG. 2 is a schematic diagram of portions of the microphone head 102, the light adaptor 120, and the microphone base 146 of the microphone system 100. For simplicity, FIGS. 1A, 1B, 1C, and 2 do not show other possible components of the microphone system 100, such as analog to digital converters, digital to analog converters, discrete components, power sources, etc. Various components included in the microphone system 100 may be implemented using software executable by one or more servers or computers, such as a computing device with a processor and memory, and/or by hardware (e.g., discrete logic circuits, application specific integrated circuits (ASIC), programmable gate arrays (PGA), field programmable gate arrays (FPGA), etc.).

The microphone system 100 may sense and capture sound through the microphone head 102 and transmit an audio signal including the captured sound from the microphone base 146 to a downstream component, such as a receiver, mixer, amplifier, processor, etc. The microphone system 100 may also include a light source 126 of the light adaptor 120 that is controllable to be turned on or off, display different colors, be different intensities, and/or flash or be solid. Commands may be received by the microphone base 146 to control the light source 126, and the microphone base 146 may translate, interpret, and/or convey the received commands to the light adaptor 120. In some embodiments, the microphone system 100 may be handheld and portable, and in other embodiments, the microphone system 100 may be permanently or temporarily installed, such as on a table, desk, or lectern. The microphone system 100 may be configured to wired or wirelessly communicate with other components.

The microphone head 102 may include a grille 104 to help minimize the sensing and capture of unwanted spurious noises due to wind, vibration, and handling. The grille 104 may be comprised of metal, foam, and/or other suitable materials. Although the grille 104 is shown in FIGS. 1A, 1B, and 1C as a semi-spherical ball shape, the grille 104 may be any suitable shape. The microphone head 102 may include a housing 106 that may contain components to sense and capture sound in the environment. The housing 106 may include one or more cartridges 110 having polar patterns, such as omnidirectional, cardioid, subcardioid, supercardioid, hypercardioid, or bidirectional. The cartridge 110 in the microphone head 102 may sense and convert the captured sound to an audio signal, as is known in the art. The cartridge 110 may be electrically connected with an electrical contact or conductive area 112 of the microphone head 102 to enable the audio signal to be conveyed to other components. The microphone head 102 may also include electrical contacts or conductive areas 114 and 116 for receiving a bias signal and ground, respectively, that originate from the microphone base 146.

The light adaptor 120 may include a housing 124 and a light source 126. The light source 126 may be controllable and illuminable to display one or more colors, be turned on or off, be different intensities, and/or flash or be solid. In embodiments, the light source 126 may be one or more light emitting diodes (LED), another luminescent light source, and/or an incandescent light source. The light source 126 may also include a suitable circuit or driver to power the LED or other type of light source. As shown in FIGS. 1A, 1B, and 1C, the light source 126 may be ring-shaped and extend completely around the exterior of the housing 124 of the light adaptor 120. As seen in FIGS. 1A and 1B, the light source 126 may be disposed near the bottom of the housing 124 of the light adaptor 120. As seen in FIG. 1C, the light source 126 may be disposed in a middle area of the housing 124 of the light adaptor 120. In embodiments, the light source 126 may have any suitable size, shape, and/or location on the housing 124. The light source 126 may include a light tube, lens, and/or a light diffuser to, for example, transmit and distribute the emitted light from a single LED over a larger area.

In embodiments, a microphone flag (not shown) may be attached to the microphone head 102, the light adaptor 120, and/or the microphone base 146. In embodiments, the light source 126 may illuminate some or all of an attached microphone flag through the use of a light tube, lens, and/or a light diffuser, for example.

The light adaptor 120 may also include a processor 130 and a receiver 132. The receiver 132 may be a communications interface that is configured to receive signals from a transmitter 156 of the microphone base 146. The signals may include various commands to control the light source 126. In embodiments, the receiver 132 and the transmitter 156 may be an infrared receiver and an infrared transmitter, respectively. As such, the signals transmitted from the transmitter 156 and received by the receiver 132 may be encoded and modulated on an infrared beam, as is known in the art. The encoding and modulation may conform to known infrared protocols or may be proprietary. In other embodiments, the receiver 132 and the transmitter 156 may be configured to wired or wirelessly communicate with one another, such as with another wireless communication scheme (e.g., radio frequency, ultrasound, laser, etc.), wiring, cables, via touching electrical contacts and/or conductive areas, etc. In embodiments, the receiver 132 and the transmitter 156 may be transceivers to enable bidirectional communication between the light adaptor 120 and the microphone base 146.

The receiver 132 of the light adaptor 120 may be electrically connected with a processor 130, and the processor 130 may be electrically connected to the light source 126. The signals received by the receiver 132 may be conveyed to the processor 130. In embodiments, the processor 130 may interpret and translate the signal, then control the light source 126 according to the signal. For example, an infrared beam may be received by the receiver 132 that includes a command to turn on the light source 126 to a yellow color. The processor 130 may interpret the received command and appropriately control and drive the light source 126 to turn on to a yellow color.

In embodiments, the light adaptor 120 may include a display (not shown) that can convey information to a user of the microphone system 100. Such a display may be an LCD display, plasma display, LED display, segment display, dot matrix display, etc. For example, the display may indicate the user's place in a speaking queue (e.g., "2", "1", "next", "on", etc.). In embodiments, the light adaptor 120 may include a device that provides haptic feedback, such as a vibrating device. For example, a vibration may be actuated when a user has reach the top of a speaking queue and the microphone has been activated.

In embodiments, the light adaptor 120 may include a pushbutton or other control switch (not shown) that may be in communication with the processor 130. The pushbutton or other control switch on the light adaptor 120 may be activated by a user, which can cause the processor 130 to control the light source 126 to turn on, turn off, and/or be a particular color, for example. As another example, the pushbutton or other control switch on the light adaptor 120 may cause the processor 130 to send a signal to the microphone base 146, such as through an infrared transceiver. This signal may indicate that the user is requesting to speak.

The light adaptor 120 may also include electrical contacts or conductive areas 134, 136, 138 and 140, 142, 144 to respectively pass through an audio signal, a bias signal, and ground between the microphone head 102 and the microphone base 146. The electrical contacts or conductive areas 134, 136, 138 and 140, 142, 144 may be electrically connected to one another in the light adaptor 120 using wires or conductive printed circuit board traces, for example.

The microphone base 146 may include a housing 150, a pushbutton or other control switch 152, and a processor 154. In embodiments, such as shown in FIGS. 1A and 1B, the housing 150 may also include a light indicator 153 that can be used to indicate whether the power to the microphone system 100 is on or off, for example. The housing 150 of the microphone base 146 may be sized and shaped to be handheld by a user (e.g., a human speaker), in embodiments. The pushbutton 152 may be activated by the user to request to speak in a meeting environment, for example, as described in more detail below. In particular, when the pushbutton 152 is activated, the processor 154 electrically connected with the pushbutton 152 may transmit a request signal to an external component over an antenna 157. In embodiments, the microphone base 146 may include other user interface controls (e.g., switches, dials, pushbuttons, etc.) and/or displays.

The microphone base 146 may also include a transmitter 156. The transmitter 156 may be a communications interface that is configured to transmit signals to the receiver 132 of the light adaptor 120, as described above. In embodiments, the transmitter 156 may be an infrared transmitter. The processor 154 may be electrically connected with the transmitter 156, and may control the transmitter 156 to transmit a signal that includes a command to control the light source 126 of the light adaptor 120.

In embodiments, the processor 154 may wirelessly receive an RF signal from an external component over an antenna 157. The RF signal may include a command to control the light source 126. For example, a moderator unit may transmit an RF signal to the microphone base 146 that includes a command to change the light source 126 to be a green color. The RF signal may be received by the antenna 157 and conveyed to the processor 154. The processor 154 of the microphone base 146 may interpret and translate the command included in the RF signal, and control the transmitter 156 to transmit a signal (e.g., an infrared beam) with the command to change the light source 126 to be green.

The processor 154 of the microphone base 146 may also receive an audio signal that ultimately originates from the microphone head 102. The processor 154 may be electrically connected with an electrical contact or conductive area 158 of the microphone base 154 to receive the audio signal. The audio signal may be processed by the processor 154 and transmitted over the antenna 157 via an RF signal to an external component, such as a receiver, mixer, amplifier, etc. In embodiments, the RF signal may include other information, such as control signals, pilot signals, and/or synchronization signals that are modulated by analog and/or digital modulation schemes, for example. The microphone base 154 may also include electrical contacts or conductive areas 160 and 162 for transmitting a bias signal and ground, respectively. A power source 159 and/or other appropriate circuitry (not shown) may supply the bias signal and ground, as in known in the art. For example, the power source 159 may be a rechargeable or a single-use battery.

The processors 130 and 154 described above may include a general purpose processor (e.g., a microprocessor) and/or a special purpose processor (e.g., a digital signal processor (DSP)). The processors 130 and 154 may be any custom made or commercially available processor. The processors 130 and 154 may also represent multiple parallel or distributed processors working in unison. The light adaptor 120 and/or the microphone base 146 may also include a memory (not shown). Such a memory may include one or more volatile (e.g., random access memory (RAM, such as DRAM, SRAM, SDRAM, etc.)) and nonvolatile (e.g., ROM, hard drive, flash drive, etc.), removable, and/or non-removable storage components, such as magnetic, optical, or flash storage, and may be integrated in whole or in part with the processors 130 and 154. These and other components may reside on devices located elsewhere on a network or in a cloud arrangement. Further, the memory may take the form of a non-transitory computer-readable storage medium, having stored thereon program instructions (e.g., compiled or non-compiled program logic and/or machine code) that, when executed by the processors 130 and 154, cause the microphone system 100 to perform one or more functions or acts, such as those described in this disclosure. Such program instructions may define or be part of a discrete software application that can be executed in response to certain inputs. The memory may also store other types of information or data, such as those types described throughout this disclosure.

The microphone head 102 may be connected and secured to the light adaptor 120, and the light adaptor 120 may be connected and secured to the microphone base 146. In this way, the light adaptor 120 may be backward compatible to be installed between existing microphone heads and microphone bases (that can themselves be connected together). In embodiments, the microphone base 102 may include external screw threading 108 that can be mated with internal screw threading 122 of the light adaptor 120. Similarly, the light adaptor 120 may include external screw threading 128 that can be mated with internal screw threading 148 of the microphone base 146. While screw threading is shown as the fastening elements in FIGS. 1A, 1B, and 1C, other suitable fastening elements can be utilized to connect and secure the microphone head 102, the light adaptor 120, and/or the microphone base 146 together, such as by using magnets, snap fasteners, clamps, clips, retaining screws, pins, etc.

Figure 3:
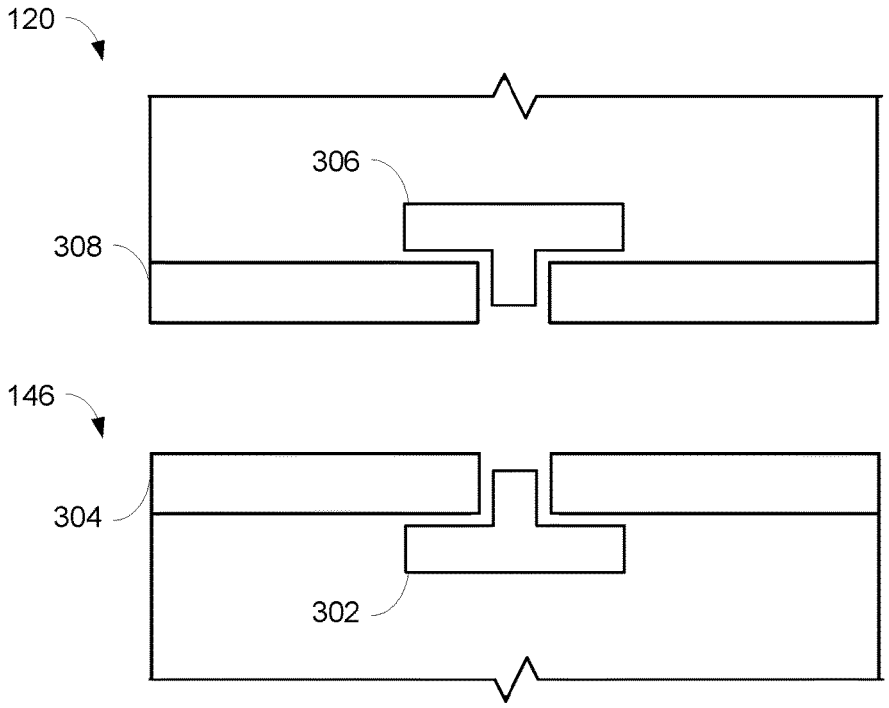
FIG. 3 is a cross-sectional exploded depiction of a portion of a light adaptor and a portion of a microphone base, in accordance with some embodiments.
Figure 4:
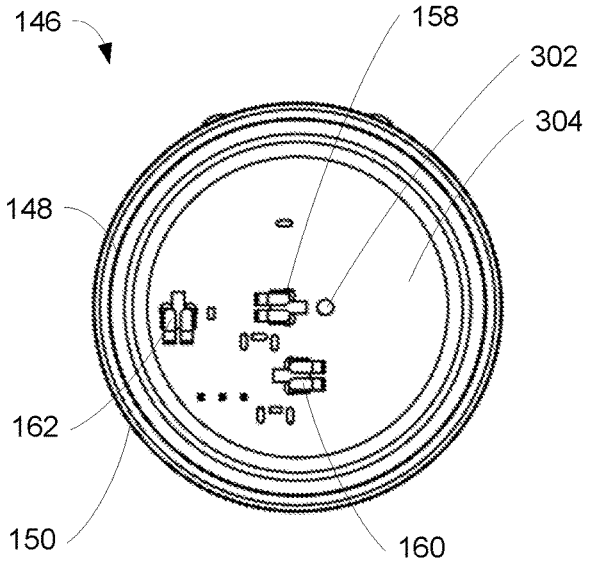
FIG. 4 is an exemplary depiction of a portion of a microphone base that can be interfaced with a light adaptor, in accordance with some embodiments.
Figure 5:
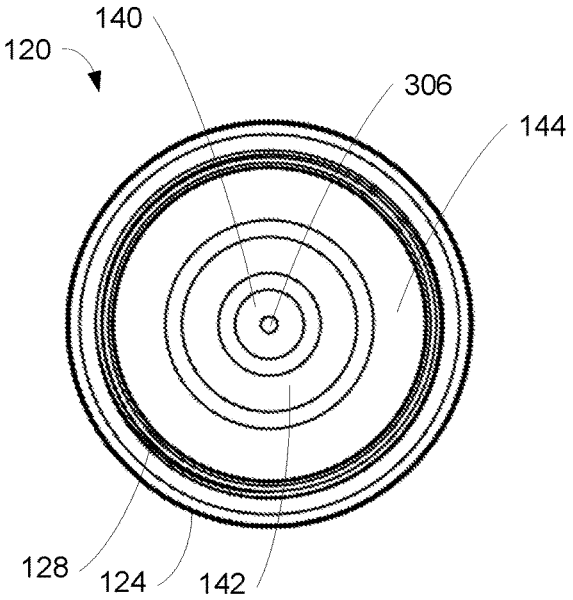
FIG. 5 is an exemplary depiction of a portion of a light adaptor that can be interfaced with a microphone base, in accordance with some embodiments.
Figure 8:
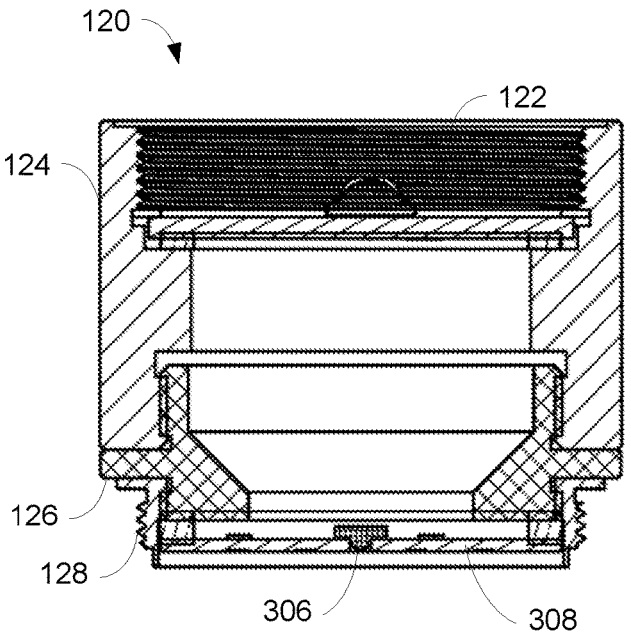
FIG. 8 is a cross-sectional exploded view of a portion of a light adaptor, in accordance with some embodiments.

FIG. 3 is a cross-sectional exploded depiction of a portion of the light adaptor 120 and a portion of the microphone base 146, and FIG. 8 is a cross-sectional exploded view of a portion of the light adaptor 120. FIG. 4 is an exemplary depiction of a portion of the microphone base 146 that can be interfaced with a light adaptor 120, and FIG. 5 is an exemplary depiction of a portion of the light adaptor 120 that can be interfaced with the microphone base 146. It is noted that fastening elements for connecting the light adaptor 120 and the microphone base 146 are not shown in FIG. 3.

An infrared transmitter 302 is shown at the top of the microphone base 146 in FIG. 3, and in particular, as exposed through a hole in a printed circuit board 304. The infrared transmitter 302 can communicate with an infrared receiver 306 at the bottom of the light adaptor 120. The infrared receiver 306 may be exposed through a hole in a printed circuit board 308 situated at a bottom of the light adaptor 120, as shown in FIGS. 3 and 8. FIG. 3 depicts that the infrared transmitter 302 and the infrared receiver 306 are generally in line with one another, but in embodiments, the infrared transmitter 302 and the infrared receiver 306 may not be aligned. However, the infrared transmitter 302 and the infrared receiver 306 may still successfully communicate due to the nature of infrared beams. That is, an infrared beam emitted from the infrared transmitter 302 may reflect and bounce off surfaces and be received by the infrared receiver 306. In particular, the infrared beam may reflect and bounce off surfaces within a cavity or space that is created between the light adaptor 120 and the microphone base 146 when they are connected to one another (e.g., screwed together).

An embodiment of the top of the microphone base 146 is depicted in FIG. 4. A hole in the printed circuit board 304 allows the infrared transmitter 302 to be exposed so that an infrared beam can be emitted. FIG. 4 also shows exemplary embodiments of components of the microphone base 146, including electrical contacts 158, 160, and 162 (for an audio signal, bias signal, and ground, respectively), housing 150, and internal screw threading 148. The electrical contacts 158, 160, and 162 may be any suitable size and/or shape.

An embodiment of the bottom of the light adaptor 120 is depicted in FIG. 5. A hole in the printed circuit board 308 (where the conductive areas are located) may allow the infrared receiver 306 to be exposed so that an infrared beam can be detected. In FIG. 5, the hole is shown in the conductive area 140. In embodiments, the hole for the infrared receiver 306 may be situated in any suitable area of the bottom of the light adaptor 120 such that the hole is located, for example, to minimize interference and/or obstruction by the electrical contacts 158, 160, and 162, while maintaining a general alignment of the infrared receiver 306 and the infrared transmitter 302. FIG. 5 also shows exemplary embodiments of components of the light adaptor 120, including conductive areas 140, 142, and 144 (for the audio signal, bias signal, and ground, respectively), housing 124, and external screw threading 128. The conductive areas 140, 142, and 144 in FIG. 5 are separated by non-conductive areas and are shown as ring-shaped, but may be any suitable size and/or shape.

Therefore, the light adaptor 120 and the microphone base 146 may be connected together by twisting the external screw threading 128 of the light adaptor 120 into the internal screw threading 148 of the microphone base 146. When the light adaptor 120 and the microphone base 146 are connected together, the conductive areas 140, 142, and 144 of the light adaptor 120 may be in physical contact and make respective electrical connections with the electrical contacts 158, 160, and 162 of the microphone base 146.

Figure 7:
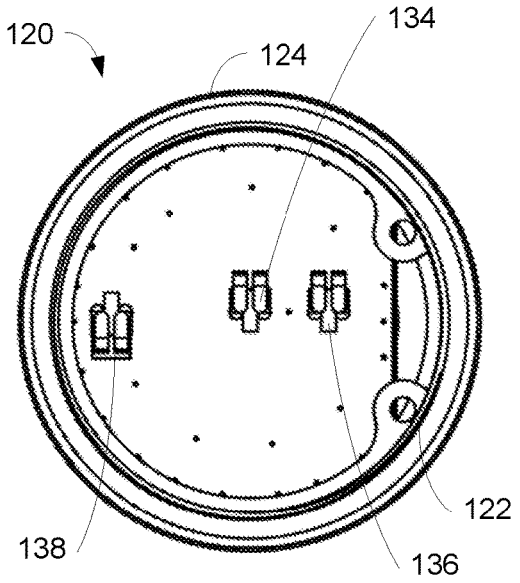
FIG. 7 is an exemplary depiction of a portion of a light adaptor that can be interfaced with a microphone head, in accordance with some embodiments.
Figure 9:
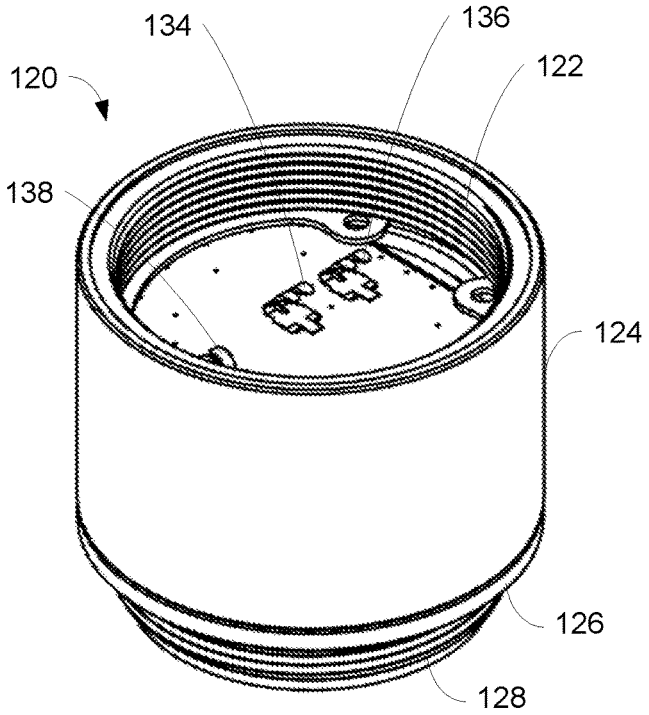
FIG. 9 is a perspective view of a portion of a light adaptor, in accordance with some embodiments.

An embodiment of the top of the light adaptor 120 is depicted in FIG. 7, and a perspective view of a portion of the light adaptor 120 is depicted in FIG. 9. The bottom of the microphone head 102 may be connected to the top of the light adaptor 120, such as by twisting the external screw threading 108 of the microphone head 102 into the internal screw threading 122 of the light adaptor 102. When the microphone head 102 and the light adaptor 120 are connected together, the electrical contacts 134, 136, and 138 of the light adaptor 120 (for the audio signal, bias signal, and ground, respectively) may be in physical contact and make electrical connections with respective electrical contacts or conductive areas 112, 114, and 116 of the microphone head 102. In this way, the audio signal, the bias signal, and the ground may be passed through the light adaptor 120 between the microphone base 146 and the microphone head 102.

Figure 6:
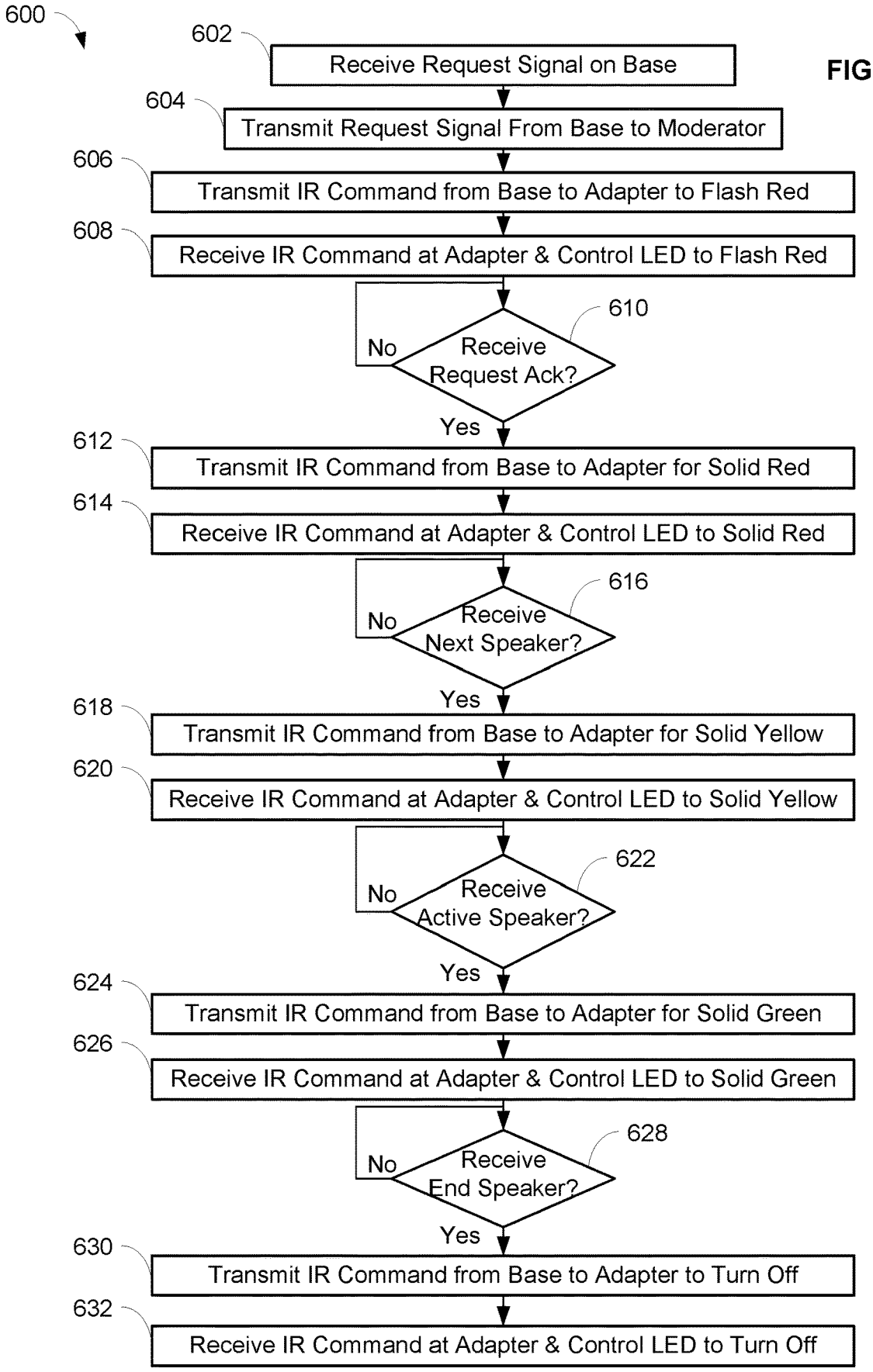
FIG. 6 is a flowchart illustrating operations for a microphone system that can be used in a speaker queuing scheme and also control a light adaptor through communications from a microphone base, in accordance with some embodiments.

An embodiment of a process 600 for a microphone system 100 including a light adaptor 120 is shown in FIG. 6. The process 600 may be utilized in a moderated meeting environment, for example, that includes a speaking queue. One or more processors and/or other processing components (e.g., analog to digital converters, encryption chips, etc.) within or external to the microphone system 100 may perform any, some, or all of the steps of the process 600. One or more other types of components (e.g., memory, input and/or output devices, transmitters, receivers, buffers, drivers, discrete components, etc.) may also be utilized in conjunction with the processors and/or other processing components to perform any, some, or all of the steps of the process 600. It should be noted that the colors, flashing state, solid state, on state, and off state described below are merely exemplary and that it is possible and contemplated for colors and states to be utilized at the various steps of the process 600.

At step 602, a request signal may be received from a user of the microphone system 100. For example, the user may activate the pushbutton 152 on the microphone base 146 to generate the request signal, which can be received by the processor 154. The request signal may indicate that the user desires to speak and would like to enter the speaking queue for the meeting. The processor 154 may transmit the request signal from the microphone base 146 to the meeting moderator at step 604. The meeting moderator may be remote from the microphone system 100, and be operating a moderator unit, for example. The request signal may be included in an RF signal that is transmitted via the antenna 157 to the meeting moderator, in some embodiments.

At step 606, the processor 154 of the microphone base 146 may control the infrared transmitter 156 to transmit an infrared beam including a command to the light adaptor 120 to turn on the light source 126 to a flashing red color. The flashing red color may indicate to the user and other meeting attendees that the user has requested to enter the speaking queue. The infrared beam including this command may be received by the infrared receiver 132 at step 608. After the infrared beam is received, the processor 130 of the light adaptor 120 may control the light source 126 to turn on to a flashing red color at step 608.

Continuing to step 610, it may be determined whether an acknowledgment of the request signal has been received from the moderator at the processor 154 of the microphone base 146. An acknowledgment by the moderator can result in adding the user of the microphone system 100 to the speaking queue. If an acknowledgment of the request signal has not been received at step 610, then the process remains at step 610. If an acknowledgment of the request signal has been received at step 610, then the process continues to step 612.

At step 612, the processor 154 of the microphone base 146 may control the infrared transmitter 156 to transmit an infrared beam including a command to the light adaptor 120 to change the light source 126 to a solid red color. The solid red color may indicate to the user and other meeting attendees that the user has entered the speaking queue and that user is now awaiting their turn to speak. The infrared beam including this command may be received by the infrared receiver 132 at step 614. After the infrared beam is received, the processor 130 of the light adaptor 120 may control the light source 126 to be a solid red color at step 614.

Continuing to step 616, it may be determined whether a signal that indicates that the user of the microphone system 100 is the next person to speak has been received from the moderator at the processor 154 of the microphone base 146. For example, the moderator unit may be controlled by the moderator to transmit such a signal when the user is the second person in the speaking queue. In embodiments, the moderator unit may automatically transmit such a signal (or the processor 154 of the microphone base 146 may internally generate such a signal) after a certain time period has elapsed after step 614. If such a signal has not been received at step 616, then the process remains at step 616. If such a signal has been received at step 616, then the process continues to step 618.

At step 618, the processor 154 of the microphone base 146 may control the infrared transmitter 156 to transmit an infrared beam including a command to the light adaptor 120 to change the light source 126 to a solid yellow color. The solid yellow color may indicate to the user and other meeting attendees that the user is the next person to speak in the speaking queue. The infrared beam including this command may be received by the infrared receiver 132 at step 620. After the infrared beam is received, the processor 130 of the light adaptor 120 may control the light source 126 to be a solid yellow color at step 620.

Continuing to step 622, it may be determined whether a signal that indicates that the user of the microphone system 100 is the active speaker has been received from the moderator at the processor 154 of the microphone base 146. For example, the moderator unit may be controlled by the moderator to transmit such a signal when the user has reached the top of the speaking queue. In embodiments, the moderator unit may automatically transmit such a signal (or the processor 154 of the microphone base 146 may internally generate such a signal) after a certain time period has elapsed after step 620. If such a signal has not been received at step 622, then the process remains at step 622. If such a signal has been received at step 622, then the process continues to step 624.

At step 624, the processor 154 of the microphone base 146 may control the infrared transmitter 156 to transmit an infrared beam including a command to the light adaptor 120 to change the light source 126 to a solid green color. The solid green color may indicate to the user and other meeting attendees that the user is the active speaker. In embodiments, the microphone system 100 may also be activated and/or unmuted at step 624. The infrared beam including this command may be received by the infrared receiver 132 at step 626. After the infrared beam is received, the processor 130 of the light adaptor 120 may control the light source 126 to be a solid green color at step 626.

Continuing to step 628, it may be determined whether a signal that indicates that the user of the microphone system 100 is no longer the active speaker has been received from the moderator at the processor 154 of the microphone base 146. For example, the moderator unit may be controlled by the moderator to transmit such a signal when the user has reached a certain time limit or the moderator has manually ended the user's time to speak. In embodiments, the moderator unit may automatically transmit such a signal (or the processor 154 of the microphone base 146 may internally generate such a signal) after a certain time period has elapsed after step 626. If such a signal has not been received at step 628, then the process remains at step 628. If such a signal has been received at step 628, then the process continues to step 630.

At step 630, the processor 154 of the microphone base 146 may control the infrared transmitter 156 to transmit an infrared beam including a command to the light adaptor 120 to turn off the light source 126. Turning off the light source may indicate to the user and other meeting attendees that the user is no longer the active speaker. In embodiments, the microphone system 100 may be deactivated and/or muted at step 630. The infrared beam including this command may be received by the infrared receiver 132 at step 632. After the infrared beam is received, the processor 130 of the light adaptor 120 may control the light source 126 to turn off at step 632.

Any process descriptions or blocks in figures should be understood as representing modules, segments, or portions of code which include one or more executable instructions for implementing specific logical functions or steps in the process, and alternate implementations are included within the scope of the embodiments of the invention in which functions may be executed out of order from that shown or discussed, including substantially concurrently or in reverse order, depending on the functionality involved, as would be understood by those having ordinary skill in the art.

This disclosure is intended to explain how to fashion and use various embodiments in accordance with the technology rather than to limit the true, intended, and fair scope and spirit thereof. The foregoing description is not intended to be exhaustive or to be limited to the precise forms disclosed. Modifications or variations are possible in light of the above teachings. The embodiment(s) were chosen and described to provide the best illustration of the principle of the described technology and its practical application, and to enable one of ordinary skill in the art to utilize the technology in various embodiments and with various modifications as are suited to the particular use contemplated. All such modifications and variations are within the scope of the embodiments as determined by the appended claims, as may be amended during the pendency of this application for patent, and all equivalents thereof, when interpreted in accordance with the breadth to which they are fairly, legally and equitably entitled.

The invention claimed is:

1. An adaptor configured for installation between a handheld microphone base and a microphone head, the adaptor comprising:

a first fastening element adapted to secure the adaptor and the handheld microphone base together, wherein the handheld microphone base comprises a base infrared transceiver;

a second fastening element adapted to secure the adaptor and the microphone head together, wherein the microphone head is configured to sense sound waves and generate an audio signal based on the sensed sound waves;

a processor;

a communications interface in communication with the processor and comprising an adaptor infrared transceiver, the communications interface configured to communicate with the handheld microphone base via infrared communication between the base infrared transceiver and the adaptor infrared transceiver; and a light source disposed on the adaptor and in communication with the processor, wherein the light source is controllable by the processor based on data received from the handheld microphone base through the communications interface.

2. The adaptor of claim 1, further comprising an activatable control switch in communication with the processor.

3. The adaptor of claim 2, wherein the control switch is configured to cause the processor to transmit a signal to the handheld microphone base through the communications interface.

4. The adaptor of claim 2, wherein the control switch is configured to cause the processor to control the light source.

5. The adaptor of claim 1, further comprising a light diffuser.

6. The adaptor of claim 5, wherein the light diffuser extends circumferentially around an exterior of the adaptor.

7. The adaptor of claim 1, further comprising:

one or more conductive areas adapted to be in electrical contact with one or more contacts of the handheld microphone base; and one or more contacts in respective electrical communication with the one or more conductive areas, the one or more contacts adapted to be in electrical contact with one or more conductive areas of the microphone head.

8. The adaptor of claim 7, wherein the one or more conductive areas comprises a cavity, and the communications interface is disposed within the cavity.

9. The adaptor of claim 1, wherein the first fastening element comprises external screw threading adapted to mechanically mate with internal screw threading of the handheld microphone base.

10. The adaptor of claim 1, wherein the second fastening element comprises internal screw threading adapted to mechanically mate with external screw threading of the microphone head.

11. The adaptor of claim 1, wherein the data received through the communications interface comprises one or more of: a command to turn on the light source, a command to turn off the light source, a command to flash the light source, a command to change an intensity of the light source, or a command to change a color of the light source.

12. The adaptor of claim 1, wherein the light source comprises one or more light emitting diodes.

13. A microphone system, comprising:

(A) a handheld microphone base comprising a base infrared transceiver;

(B) a microphone head configured to sense sound waves and generate an audio signal based on the sensed sound waves; and (C) a light adaptor detachably connected between the handheld microphone base and the microphone head, the light adaptor comprising:

a communications interface comprising an adaptor infrared transceiver and configured to communicate with the handheld microphone base via infrared communication between the base infrared transceiver and the adaptor infrared transceiver;

a light source disposed on the light adaptor and configured to be controlled based on data received through the communications interface; and one or more electrical connections configured to convey signals between the handheld microphone base and the microphone head.

14. The microphone system of claim 13, wherein each of the handheld microphone base, the microphone head, and the light adaptor comprise one or more fastening elements configured to secure the handheld microphone base, the microphone head, and the light adaptor together.

15. The microphone system of claim 13, wherein the data received through the communications interface comprises one or more of: a command to turn on the light source, a command to turn off the light source, a command to flash the light source, a command to change an intensity of the light source, or a command to change a color of the light source.

16. The microphone system of claim 13, wherein the handheld microphone base comprises a pushbutton configured to, when actuated, cause the handheld microphone base to transmit a command to the communications interface of the light adaptor.

17. A method for controlling a light source of a light adaptor configured for installation between a handheld microphone base and a microphone head configured to sense sound waves, the method comprising:

receiving a first signal at a base processor of the handheld microphone base;

in response to receiving the first signal, transmitting a first command from the base processor to a first infrared transceiver of the handheld microphone base, the first command for controlling the light source that is disposed on the light adaptor to be a first color;

transmitting the first command from the first infrared transceiver via infrared communication;

receiving the first command at a second infrared transceiver of the light adaptor;

in response to receiving the first command, controlling the light source of the light adaptor to be the first color, using an adaptor processor;

receiving a second signal at the base processor of the handheld microphone base;

in response to receiving the second signal, transmitting a second command from the base processor to the first infrared transceiver of the handheld microphone base, the second command for controlling the light source of the light adaptor to be a second color;

transmitting the second command from the first infrared transceiver via infrared communication;

receiving the second command at the second infrared transceiver of the light adaptor; and in response to receiving the second command, controlling the light source of the light adaptor to be the second color, using the adaptor processor.

* * * * *